US007477215B2

(12) United States Patent
Kim et al.

(10) Patent No.: US 7,477,215 B2
(45) Date of Patent: Jan. 13, 2009

(54) PLASMA DISPLAY APPARATUS AND DRIVING METHOD THEREOF

(75) Inventors: Min Soo Kim, Gumi-si (KR); Ki-Duck Cho, Gumi-si (KR); Kyung Ryeol Shim, Guoan (KR); Won Jae Kim, Masan-si (KR)

(73) Assignee: LG Electronics Inc., Seoul (KR)

( * ) Notice: Subject to any disclaimer, the term of this patent is extended or adjusted under 35 U.S.C. 154(b) by 630 days.

(21) Appl. No.: 11/122,028

(22) Filed: May 5, 2005

(65) Prior Publication Data

US 2005/0248504 A1 Nov. 10, 2005

(30) Foreign Application Priority Data

May 6, 2004 (KR) ..... 10-2004-0031700

(51) Int. Cl.
*G09G 3/28* (2006.01)
*G09G 5/10* (2006.01)

(52) U.S. Cl. ..... 345/68; 345/60; 345/67; 345/204; 345/690

(58) Field of Classification Search ..... 345/55, 345/60, 63, 67, 68, 204, 205, 206, 690; 315/111.01, 315/111.21, 169.1, 169.4; 313/483, 484, 313/567, 581, 584, 585, 604, 622
See application file for complete search history.

(56) References Cited

U.S. PATENT DOCUMENTS

| | | | | |
|---|---|---|---|---|
| 6,160,529 | A | 12/2000 | Asao et al. | |
| 6,677,920 | B2 * | 1/2004 | Huang et al. | 345/60 |
| 2006/0267870 | A1 * | 11/2006 | Yoo | 345/60 |

FOREIGN PATENT DOCUMENTS

| | | |
|---|---|---|
| JP | 08-221036 | 8/1996 |
| JP | 11-167367 | 6/1999 |
| KR | 1020010004315 A | 1/2001 |
| KR | 1020040009331 A | 1/2004 |

* cited by examiner

*Primary Examiner*—My-Chau T Tran
(74) *Attorney, Agent, or Firm*—Birch, Stewart, Kolasch & Birch, LLP

(57) ABSTRACT

A plasma display apparatus and a method of driving the same are disclosed. According to the plasma display apparatus and the method of driving the same, when a plasma display panel (PDP) displays a screen with one frame comprised of a plurality of sub-fields including reset periods, different reset pulses are supplied to a first scan electrode and a second scan electrode in the reset period of an arbitrary sub-field among the plurality of sub-fields.

34 Claims, 7 Drawing Sheets

PLASMA DISPLAY APPARATUS AND DRIVING METHOD THEREOF

This nonprovisional application claims priority under 35 U.S.C. § 119(a) on Patent Application No. 2004-0031700 filed in Korea on May 6, 2004, the entire contents of which are hereby incorporated by reference.

BACKGROUND OF THE INVENTION

1. Field of the Invention

The present invention relates to a plasma display apparatus and a method of driving the same, and more particularly to a plasma display apparatus capable of improving contrast and a method of driving the same.

2. Description of the Background Art

A plasma display panel (PDP) emits light from a fluorescent body by ultraviolet (UV) rays generated when an inactive mixed gas such as He+Xe, Ne+Xe, and He+Xe+Ne is discharged to display images. Such a PDP is easily made thin and large and provides significantly improved picture quality due to recent development of technology.

Referring to FIG. 1, a conventional three-electrode AC surface discharge type PDP includes scan electrodes Y1 to Yn and sustain electrodes Z and address electrodes X1 to Xm that intersect the scan electrodes Y1 to Yn and the sustain electrodes Z.

Cells 1 for displaying one of red, green, and blue are formed in the intersections of the scan electrodes Y1 to Yn, the sustain electrodes Z, and the address electrodes X1 to Xm. The scan electrodes Y1 to Yn and the sustain electrodes Z are formed on a top substrate that is not shown. A dielectric layer and an MgO protective layer that are not shown are laminated on the top substrate. The address electrodes X1 to Xm are formed on a bottom substrate that is not shown. A partition wall for preventing optical and electrical interference between adjacent cells is horizontally formed on the bottom substrate. A fluorescent body excited by vacuum UV to emit visible rays is formed on the surfaces of the bottom substrate and the partition wall. A mixed gas required for discharge such as He+Xe, Ne+Xe, and He+Xe+Ne is implanted into a discharge space between the top substrate and the bottom substrate.

In order to realize gray scales of an image, a PDP divides a frame into various sub fields having different numbers of time of light emission to perform time division driving. Each sub field is divided into a reset period for initializing the entire screen, an address period for selecting a scan line and for selecting a cell from the selected scan line, and a sustain period for realizing gray scales in accordance with the number of times of discharge. For example, when an image is displayed by 256 gray scales, as illustrated in FIG. 2, a frame period (16.67 ms) corresponding to 1/60 second is divided into eight sub fields SF1 to SF8. As described above, each of the eight sub fields SF1 to SF8 is divided into the reset period, the address period, and the sustain period. Meanwhile the reset period and the address period of the respective sub fields are the same, the sustain period in each sub field and the number of sustain pulses assigned to the sustain period increase in the ratio of $2^n$ (n=0, 1, 2, 3, 4, 5, 6, and 7).

FIG. 3 illustrates an example of driving waveforms applied to a PDP.

Referring to FIG. 3, according to a method of driving the conventional PDP, in each sub-field (SFi, SFi+1), set-up discharge is generated using a rising ramp waveform Ramp-up and set-down discharge is generated using a falling ramp waveform Ramp-dn to initialize cells.

The rising ramp waveform Ramp-up is simultaneously supplied to all of the scan electrodes Y in the reset period of each sub-field (SFi, SFi+1). At the same time, 0[V] is supplied to the sustain electrodes Z and the address electrodes X. Set-up discharge is generated by the rising ramp waveform Ramp-up in the cells of the entire screen between the scan electrodes Y and the address electrodes X and the scan electrodes Y and the sustain electrodes Z. Positive (+) wall charges are accumulated on the address electrodes X and the sustain electrodes Z and negative (−) wall charges are accumulated on the scan electrodes Y due to the set-up discharge.

Subsequent to the rising ramp waveform Ramp-up, the falling ramp waveform Ramp-dn that starts to fall from a sustain voltage Vs lower than the set-up voltage Vsetup of the rising ramp waveform Ramp-up and that falls to a negative specific voltage is simultaneously supplied to the scan electrodes Y. At the same time, a bias voltage Vz is supplied to the sustain electrodes Z and 0[V] is supplied to the address electrodes X. The bias voltage Vz may be determined as the sustain voltage Vs. When the falling ramp waveform Ramp-dn is supplied, set-down discharge is generated between the scan electrodes Y and the sustain electrodes Z. Excessive wall charges that are not required for address discharge among the wall charges generated during the set-up discharge are erased by the set-down discharge.

In the address period of each sub-field (SFi, SFi+1), scan pulses Scp of a negative writing voltage −Vw are sequentially supplied to the scan electrodes Y and data pulses Dp of a positive data voltage Vd synchronized with the scan pulse Scp are supplied to the address electrodes X. At this time, the voltages of the scan pulses Scp and the data pulses Dp and the wall voltage generated in the reset period are added to each other to generate address discharge in the cell to which the data pulses Dp are supplied.

In the sustain period of each sub-field (SFi, SFi+1), sustain pulses Susp of the sustain voltage Vs are alternately supplied to the scan electrodes Y and the sustain electrodes Z. In the cell selected by the address discharge, sustain discharge, that is, display discharge is generated between the scan electrodes Y and the sustain electrodes Z whenever the wall voltage in the cell and the sustain voltage Vs are added to each other to supply each sustain pulse Susp. The sustain period and the number of sustain pulses Susp vary in accordance with the brightness weight given to a sub-field.

An erasing signal for erasing remaining charges in a cell may be supplied to the scan electrodes Y or the sustain electrodes Z after the sustain discharge is completed.

According to the driving waveform illustrated in FIG. 3, at the point of time where the set-down discharge is completed, the set-down voltage of the falling ramp waveform Ramp-dn is fixed to potential higher than the negative writing voltage −Vw of the scan pulses Scp by ΔV. Since the falling ramp waveform Ramp-dn reduces the positive wall charges excessively accumulated on the address electrodes X by the set-up discharge, when the set-down voltage of the falling ramp waveform Ramp-dn is fixed to the potential higher than the negative writing voltage −Vw, more positive wall charges may reside on the address electrodes X. According to the driving waveform illustrated in FIG. 3, since it is possible to reduce the voltage (Vd, −Vw) required for the address discharge, it is possible to reduce a PDP by a low voltage.

According to the conventional PDP driven by the above-described method, it is possible to stably display images corresponding to the gray scales of sub-fields. However, according to the conventional PDP, contrast deteriorates due to light generated in the reset period.

In more detail, as illustrated in FIG. 3, according to the method of driving the conventional PDP, the rising ramp waveform Ramp-up is supplied in each reset period of all the sub-fields included in one frame. Therefore, the set-up discharge is generated in each reset period of all of the sub-fields. The set-up discharge is generated by the rising ramp waveform Ramp-up that rises to the set-up voltage Vsetup that is higher than the sustain voltage Vs such that desired wall charges may be formed in all of the discharge cells. Therefore, predetermined light is generated by the set-up discharge generated by the rising ramp waveform Ramp-up in all of the discharge cells, which deteriorates the contrast of a PDP.

SUMMARY OF THE INVENTION

Accordingly, an object of the present invention is to solve at least the problems and disadvantages of the background art.

It is an object of the present invention to provide a plasma display apparatus capable of improving contrast and a method of driving the same.

According to the plasma display apparatus of the present invention and the method of driving the same, when a plasma display panel (PDP) displays a screen with one frame comprised of a plurality of sub-fields including reset periods, different reset pulses are supplied to a first scan electrode and a second scan electrode in a reset period of an arbitrary sub-field among the plurality of sub-fields.

According to the present invention, it is possible to reduce the amount of light generated in the reset period and to thus improve contrast.

BRIEF DESCRIPTION OF THE DRAWINGS

The present invention will be described in detail with reference to the following drawings in which like numerals refer to like elements.

DETAILED DESCRIPTION OF PREFERRED EMBODIMENTS

Figure 1:
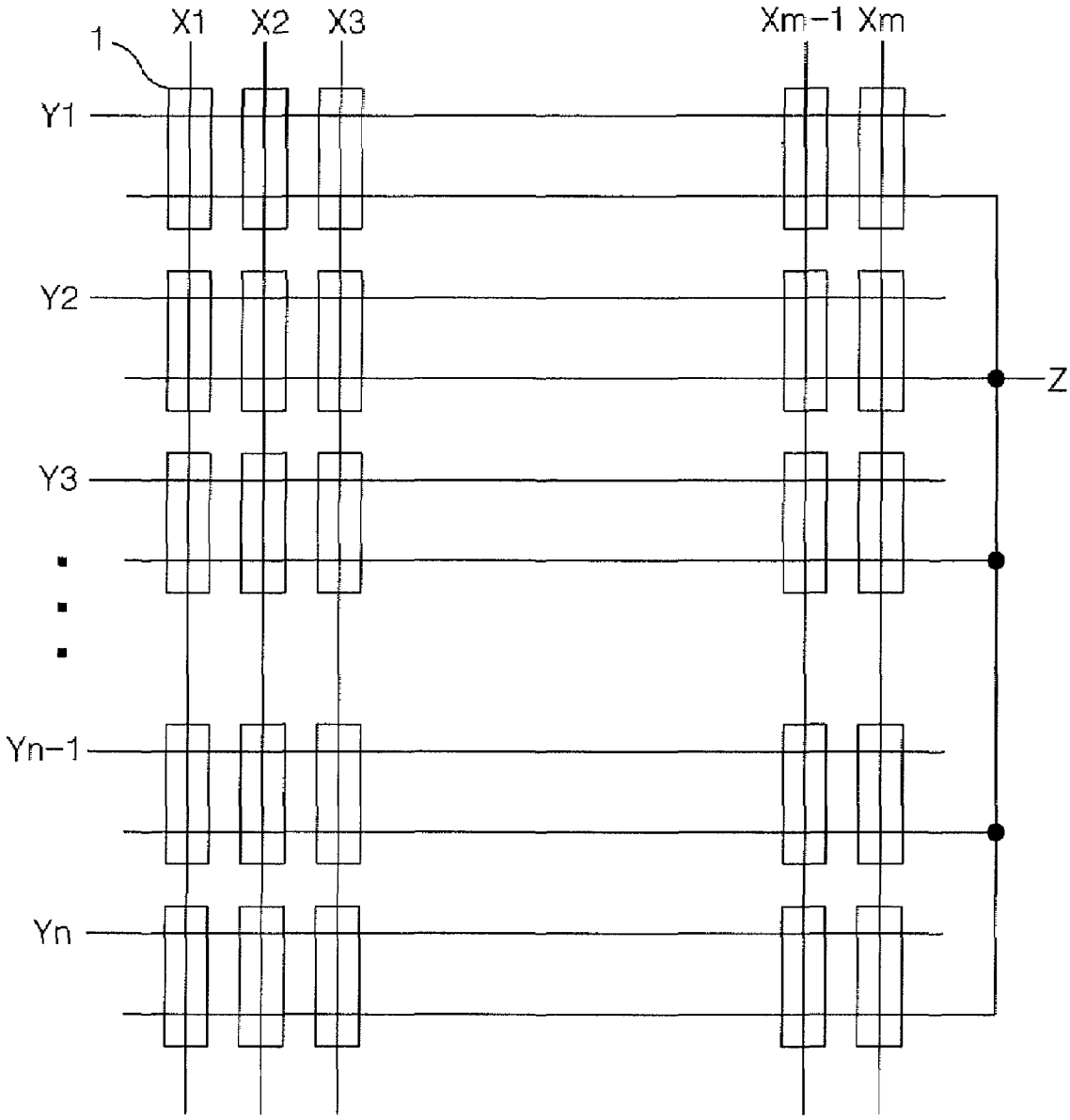
Fig. 1 Related Art
FIG. 1 schematically illustrates an arrangement of electrodes of a conventional three-electrode AC surface discharge type plasma display panel (PDP).
Figure 2:
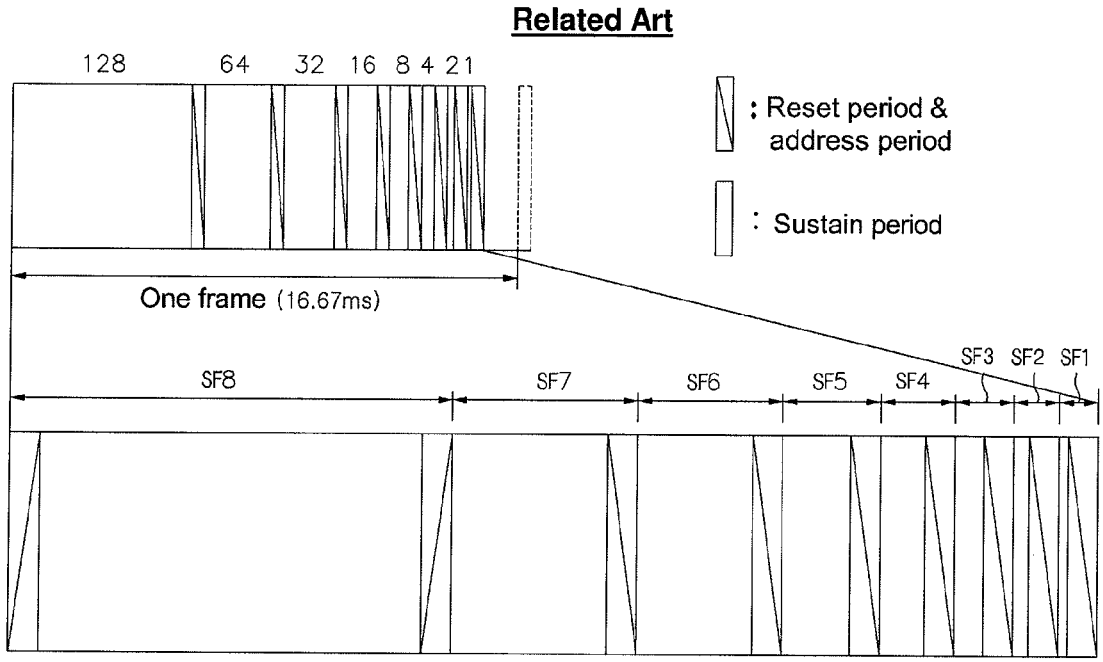
FIG. 2 illustrates the structure of a frame of an 8-bit default code for realizing 256 gray scales.
Figure 3:
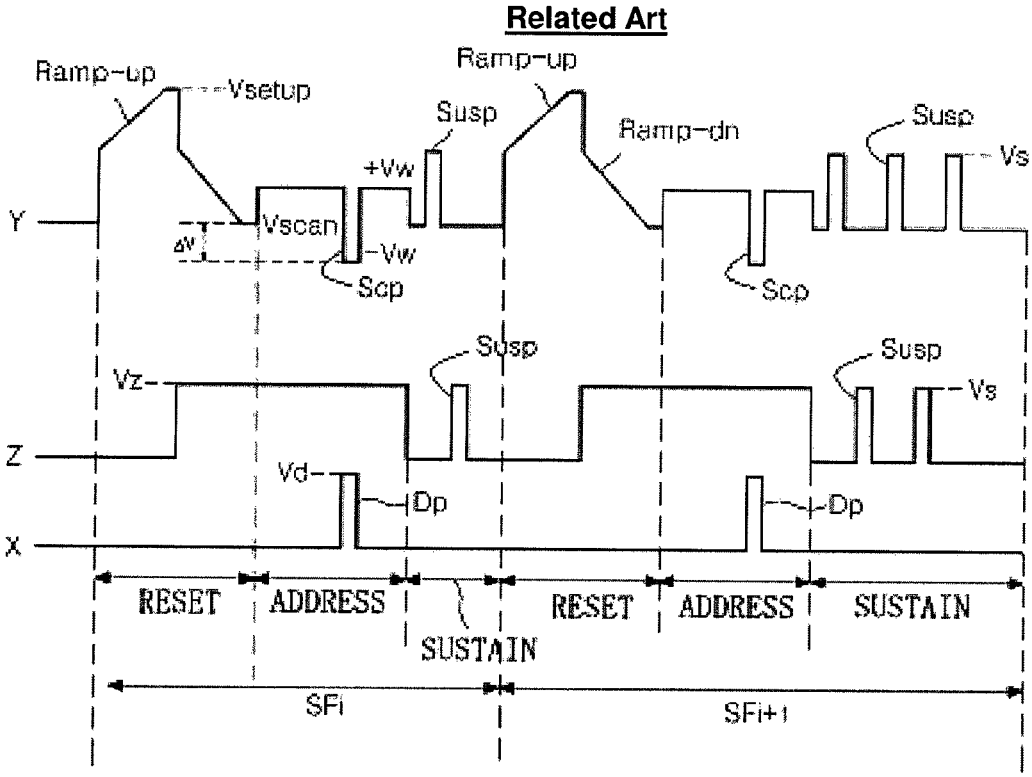
FIG. 3 illustrates driving waveforms for driving a conventional PDP.

Preferred embodiments of the present invention will be described in a more detailed manner with reference to the drawings.

According to a plasma display apparatus of the present invention and a method of driving the same, when a plasma display panel (PDP) displays a screen with one frame comprised of a plurality of sub-fields including reset periods, different reset pulses are supplied to a first scan electrode and a second scan electrode in a reset period of an arbitrary sub-field among the plurality of sub-fields.

The first scan electrode and the second scan electrode are adjacent to each other.

Each of the first scan electrode and the second scan electrode is comprised of a scan electrode group comprising two or more scan electrodes.

The arbitrary sub-field is the first sub-field of the frame.

A reset pulse supplied to the first scan electrode in the reset period of the first sub-field of the frame among the arbitrary sub-fields comprises a rising ramp pulse and a falling ramp pulse and a reset pulse supplied to the second scan electrode in the reset period of the first sub-field of the frame among the arbitrary sub-fields comprises the falling ramp pulse.

The first sub-field of the frame has the lowermost weight.

The reset pulse supplied to the first scan electrode and the second scan electrode in the reset periods of the remaining sub-fields excluding the first sub-field of the frame comprises the falling ramp pulse.

The second scan electrode sustains a voltage lower than the voltage of the rising ramp pulse in a period where the rising ramp pulse is supplied to the first scan electrode.

A voltage lower than the voltage of the rising ramp pulse is a sustain voltage.

The pulse supplied to the first scan electrode and the second scan electrode after the sustain period of the final sub-field of the frame comprises the falling ramp pulse.

The pulse supplied to the first scan electrode after the sustain period of the final sub-field of the frame comprises a sustain pulse sustained as the sustain voltage and the falling ramp pulse that falls from the sustain voltage to a predetermined voltage and the pulse supplied to the second scan electrode after the sustain period of the final sub-field of the frame is the sustain pulse sustained as the sustain voltage.

The period of the sustain pulse supplied to the first scan electrode is shorter than the period of the sustain pulse supplied to the second scan electrode.

The sustain pulse of the sustain voltage supplied to the second scan electrode is sustained before the falling ramp pulse is supplied to the first scan electrode in the reset period of the first sub-field of the next frame after the frame.

The pulse supplied to the first scan electrode and the second scan electrode after the sustain period of the final sub-field of the frame is a sustain pulse sustained as the sustain voltage.

The sustain pulse of the sustain voltage supplied to the first scan electrode and the second scan electrode is sustained before the falling ramp pulse is supplied to the first scan electrode and the rising ramp pulse is supplied to the second scan electrode in the reset period of the first sub-field of the next frame after the frame.

The pulse supplied to the first scan electrode after the sustain period of the final sub-field of the frame is the rising ramp pulse that gradually rises from the sustain voltage to a predetermined voltage and the pulse supplied to the second scan electrode after the sustain period of the final sub-field of the frame is the sustain pulse sustained as the sustain voltage.

The predetermined voltage of the rising ramp pulse supplied to the first scan electrode and the sustain voltage of the sustain pulse supplied to the second scan electrode are sustained to the reset period of the first sub-field of the next frame after the frame.

Hereinafter, preferred embodiments of the present invention will be described in detail with reference to the attached drawings.

Figure 4:
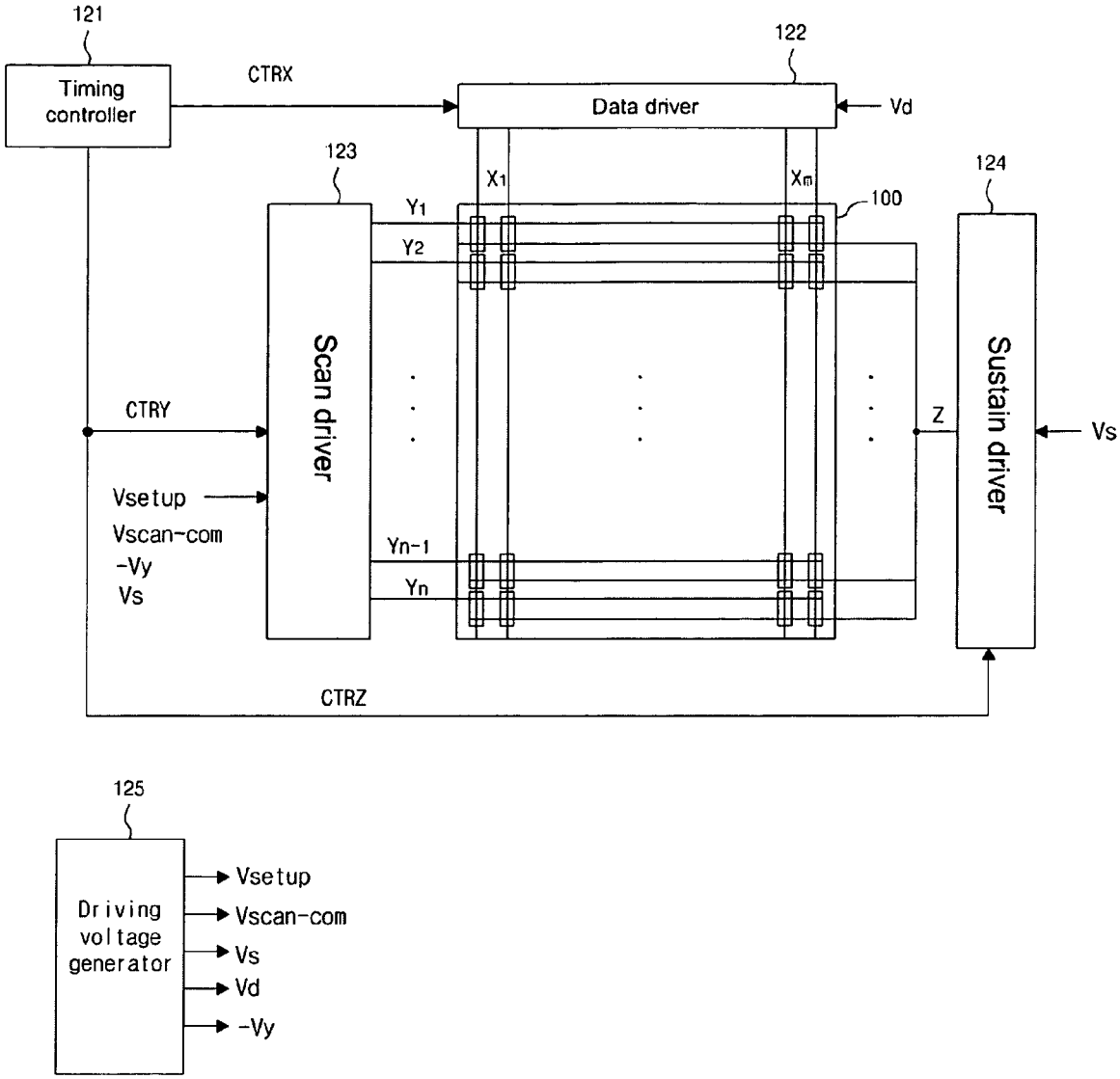
FIG. 4 schematically illustrates the structure of a plasma display apparatus according to the present invention.

FIG. 4 schematically illustrates the structure of a plasma display apparatus according to the present invention.

As illustrated in FIG. 4, the plasma display apparatus according to the present invention includes a plasma display panel (PDP) 100, a data driving part 122 for supplying data to address electrodes X1 to Xm formed on a bottom substrate (not shown) of the PDP 100, a scan driving part 123 for driving scan electrodes Y1 to Yn, a sustain driving part 124 for driving sustain electrodes Z that are common electrodes, a timing control part 121 for controlling the data driving part 122, the scan driving part 123, the sustain driving part 124, and a sustain pulse control part 126 when the PDP is driven, and a driving voltage generating part 125 for supplying necessary driving voltage to the respective driving parts 122, 123, and 124.

The plasma display apparatus according to the present invention displays an image comprised of a frame by a combination of one or more sub-fields in which driving pulses are applied to the address electrodes, the scan electrodes, and the sustain electrodes in a reset period, an address period, and a sustain period.

In the PDP 100, a top substrate (not shown) and a bottom substrate (not shown) are attached to each other by uniform distance. On the top substrate, a plurality of electrodes, for example, the scan electrodes Y1 to Yn and the sustain electrodes Z are formed to make pairs. On the bottom substrate, the address electrodes X1 to Xm are formed so as to intersect the scan electrodes Y1 to Yn and the sustain electrodes Z.

Data that is inverse gamma corrected and error diffused by an inverse gamma correcting circuit and an error diffusing circuit that are not shown to be mapped by a sub-field mapping circuit in each sub-field is supplied to the data driving part 122. The data driving part 122 samples and latches data in response to a timing control signal CTRX from the timing control part 121 and supplies the data to the address electrodes X1 to Xm.

The scan driving part 123 supplies different reset pulses to the scan electrodes Y1 to Yn under the control of the timing control part 121 in the reset period. Also, the scan driving part 123 sequentially supplies scan pulses Sp of a scan voltage −Vy to the scan electrodes Y1 to Yn under the control of the timing controller 121 in an address period.

The sustain driving part 124 supplies the bias voltage of a sustain voltage Vs to the sustain electrodes Z under the control of the timing control part 121 from a period where a falling ramp waveform Ramp-dn is generated to the address period or in the address period and alternately operates together with the scan driving part 123 in the sustain period to supply sustain pulses sus to the sustain electrodes Z.

The timing control part 121 receives vertical/horizontal synchronizing signals and a clock signal, generates timing control signals CTRX, CTRY, and CTRZ for controlling the operation timings and the synchronizations of the respective driving parts 122, 123, and 124 in the reset period, the address period, and the sustain period, and supplies the timing control signals CTRX, CTRY, and CTRZ to the corresponding driving parts 122, 123, and 124 to control the respective driving parts 122, 123, and 124.

On the other hand, a sampling clock for sampling data, a latch control signal, and a switch control signal for controlling the on/off times of an energy collecting circuit and a driving switch element are included in the data control signal CTRX. A switch control signal for controlling the on/off times of the energy collecting circuit and the driving switch element in the scan driving part 123 is included in the scan control signal CTRY. A switch control signal for controlling the on/off times of the energy collecting circuit and the driving switch element in the sustain driving part 124 is included in the sustain control signal CTRZ.

The driving voltage generating part 125 generates a set-up voltage Vsetup, a scan common voltage Vscan-com, a scan voltage −Vy, a sustain voltage Vs, and a data voltage Vd. Such driving voltages may change due to the composition of a discharge gas or the structure of a discharge cell.

Driving methods of the plasma display apparatus according to the present invention having the above-described structure will be described with reference to FIGS. 5 to 8.

Figure 5:
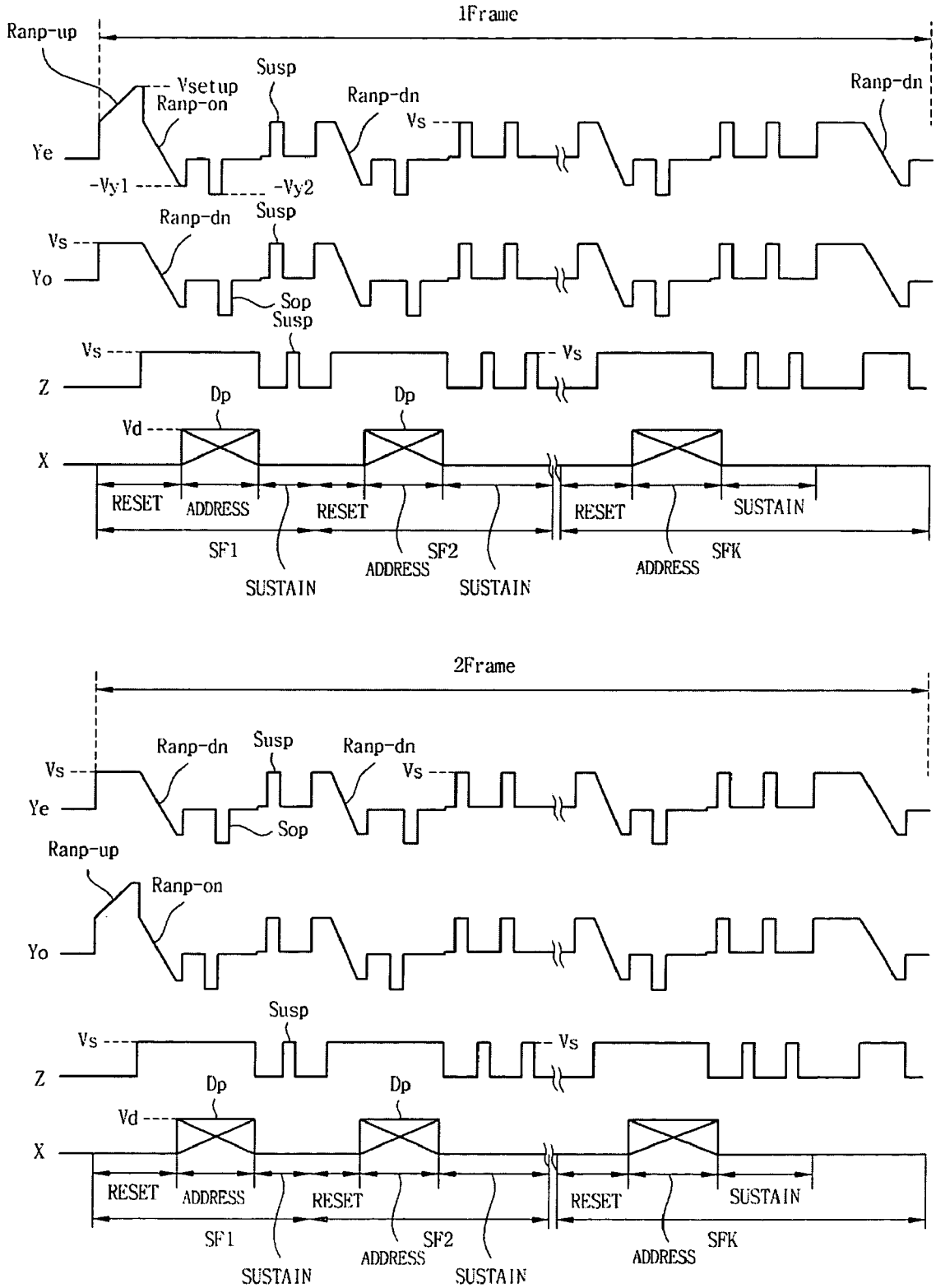
FIG. 5 illustrates a first driving method of the plasma display apparatus according to the present invention.

FIG. 5 illustrates a first driving method of the plasma display apparatus according to the present invention. Referring to FIG. 5, according to the first driving method of the plasma display apparatus of the present invention, the rising ramp pulse Ramp-up supplied in the reset period of a sub-field is supplied to an arbitrary sub-field among a plurality of sub-fields included in one frame, however, is preferably supplied to a first sub-field. Here, the first sub-field preferably has the lowermost weight. Different reset pulses are supplied to the first scan electrode and the second scan electrode in the reset period of the first sub-field of the frame. At this time, each of the first scan electrode and the second scan electrode may be comprised of a group of scan electrodes including two or more scan electrodes or a single scan electrode to be driven. At this time, the first scan electrode and the second scan electrode are preferably adjacent to each other.

Hereinafter, a driving method in accordance with driving waveforms supplied in the reset periods, the address periods, and the sustain periods of the first sub-field and the remaining sub-fields of each frame will be described. The above-described first scan electrode and second scan electrode will be described as odd scan electrodes and even scan electrodes.

***First Frame***

<First Sub-Field>

In the reset period of a first sub-field SF1 of a first frame SFj, the rising ramp waveform Ramp-up of the set-up voltage Vsetup is supplied to even scan electrodes Ye. At the same time, a discharge control voltage of a voltage level lower than the voltage level of the voltage of the rising ramp waveform, preferably, a discharge control voltage of a sustain voltage level is supplied to odd scan electrodes Yo. 0[V] is supplied to the sustain electrodes Z and the address electrodes X.

In the cells where the even scan electrodes Ye to which the rising ramp waveform Ramp-up is supplied are formed, set-up discharge is generated between the scan electrodes Y and the address electrodes X and between the scan electrodes Y and the sustain electrodes Z. Due to the set-up discharge, positive (+) wall charges are accumulated on the address electrodes X and the sustain electrodes Z and negative (−) wall charges are accumulated on the scan electrodes Y.

The set-up discharge is not generated in the cells where the odd scan electrodes Yo to which the discharge control voltage is supplied are formed. In more detail, the discharge control voltage supplied to the odd scan electrodes Yo is set as a sustain voltage Vs. Therefore, a voltage to the amount that generates the set-up discharge is not applied to the cells. As a result, the set-up discharge is not generated in the cells where the odd scan electrodes Yo are formed.

Subsequent to the rising ramp waveform Ramp-up and the discharge control voltage, a falling ramp waveform Ramp-dn in which a voltage is gradually reduced from the sustain voltage Vs to a first negative voltage −Vy1 is supplied to all of the scan electrodes Y. As illustrated in FIG. 5, a bias voltage Vz is supplied to the sustain electrodes Z at the point of time where the falling ramp waveform Ramp-dn is supplied. However, after the falling ramp waveform is supplied, the bias voltage may be supplied to the sustain electrodes Z at the point of time where the address period starts. At this time, the bias voltage Vz may be determined as the sustain voltage Vs. 0[V] is supplied to the address electrodes X.

When the falling ramp waveform Ramp-dn is supplied, set-down discharge is generated in the cells where the even scan electrodes Ye in which the set-up discharge is generated are formed. Excessive wall charges that are not required for address discharge among the wall charges generated by the set-up discharge are erased by the set-down discharge. On the other hand, when the falling ramp waveform Ramp-dn is supplied, the set-down discharge is not generated in the cells where the odd scan electrodes Yo are formed. The wall charges of all of the cells converge into the positions of off-cells by the final pulse of a previous frame SFi-1, which will be described in detail. Therefore, the set-down discharge is not generated in the cells where the odd scan electrodes Yo in which the set-up discharge is not generated are formed.

The wall charges of all of the discharge cells converge into the positions of the off-cells over the reset period. In more detail, the wall charges of the discharge cells are divided into on-cells and off-cells in accordance with whether or not sustain discharge is generated. The wall charges of the on-cells mean that discharge can be generated corresponding to the voltage of sustain pulses sus. The wall charges of the off-cells mean that discharge is not generated by the voltage of the sustain pulses sus but is generated by the supply of scan pulses Scp and data pulses Dp.

In the address period, the scan pulses Scp of a second negative voltage −Vy2 whose absolute value is larger than the absolute value of a first negative voltage −Vy1 are sequentially supplied to the scan electrodes Y and, at the same time, the data pulses Dp of a positive data voltage Vd synchronized with the scan pulses Scp are supplied to the address electrodes X.

The voltages of the scan pulses Scp and the data pulses Dp and the wall voltage generated in the reset period are added to each other to generate the address discharge in the cell to which the data pulses Dp are supplied. The bias voltage Vz is supplied to the sustain electrodes Z in the address period.

In the sustain period, the sustain pulses sus of the sustain voltage Vs are alternately supplied to the scan electrodes Y and the sustain electrodes Z. In the cell selected by the address discharge, the wall voltage in the cell and the sustain voltage Vs are added to each other such that the sustain discharge is generated between the scan electrodes Y and the sustain electrodes Z whenever each sustain pulse Susp is supplied.

<Sub-Fields subsequent to First Sub-Field>

Reset pulses including the falling ramp pulse Ramp-dn are supplied to all of the scan electrodes Y in the reset periods of the sub-fields SF2, . . . excluding the reset period of the first sub-field SF1 of the first frame.

In more detail, in the reset period of the second sub-field, a voltage lower than the voltage of the rising reset pulse supplied in the reset period of the first sub-field, preferably, the sustain voltage Vs is supplied to the scan electrodes Y for a predetermined time and then, the falling ramp waveform Ramp-dn in which a voltage is gradually reduced from the sustain voltage Vs to the first negative voltage −Vy1 is applied to all of the scan electrodes Y. At this time, the sustain voltage Vs is supplied to a cell for no less than a predetermined time such that initial discharge is generated in the cell and then, the set-down discharge is generated in the cell by the falling ramp waveform Ramp-dn. The excessive wall charges that are not required for the address discharge among the wall charges generated during the initial discharge are erased by the set-down discharge. Since the discharge cells in which the sustain discharge is not generated in the sustain period of the first sub-field sustain off-cell wall charges, the set-down discharge is not generated in the cells.

The bias voltage Vz is supplied to the sustain electrodes Z in the period where the falling ramp waveform Ramp-dn is supplied to the scan electrodes Y. Like in the first sub-field, the bias voltage may be supplied at the point of time where the address period starts.

In the address period, the scan pulses Scp of the second negative voltage −Vy2 whose absolute value is larger than the absolute value of the first negative voltage −Vy1 are sequentially supplied to the scan electrodes Y and, at the same time, the data pulses Dp of the positive data voltage Vd synchronized with the scan pulses Scp are supplied to the address electrodes X.

The voltages of the scan pulses Scp and the data pulses Dp and the wall voltage generated in the reset period are added to each other to generate the address discharge in the cells to which the data pulses Dp are supplied. The bias voltage Vz is supplied to the sustain electrodes Z in the address period.

In the sustain period, the sustain pulses sus of the sustain voltage Vs are alternately supplied to the scan electrodes Y and the sustain electrodes Z. In the cell selected by the address discharge, the wall voltage in the cell and the sustain voltage Vs are added to each other such that the sustain discharge is generated between the scan electrodes Y and the sustain electrodes Z whenever each sustain pulse Susp is supplied. According to the present invention, the above-described processes are repeated to display a predetermined image corresponding to data.

<Final Sub-Field>

On the other hand, after the sustain period of the final sub-field SFk of the first frame, the sustain voltage Vs is supplied to all of the scan electrodes Y for a predetermined time and then, the falling ramp waveform Ramp-dn in which a voltage is gradually reduced from the sustain voltage Vs to the first negative voltage −Vy1 is applied to all of the scan electrodes Y. At this time, the sustain voltage Vs is supplied to a cell for a predetermined time such that initial discharge is generated in the cell and then, the set-down discharge is generated in the cell by the falling ramp waveform Ramp-dn. The excessive wall charges that are not required for the address discharge among the wall charges generated during the initial discharge are erased by the set-down discharge. Since the discharge cells in which the sustain discharge is not generated in the sustain period of the kth sub-field sustain off-cell wall charges, the set-down discharge is not generated in the discharge cells.

***Second Frame***

<First Sub-Field>

In the reset period of a first sub-field SF1 of a second frame SFj+1, the rising ramp waveform Ramp-up of the set-up voltage Vsetup is supplied to odd scan electrodes Yo. At the same time, the discharge control voltage of the voltage level lower than the voltage level of the voltage of the rising ramp waveform, preferably, the discharge control voltage of the sustain voltage Vs level is supplied to even scan electrodes Ye. 0[V] is supplied to the sustain electrodes Z and the address electrodes X.

In the cells where the odd scan electrodes Yo to which the rising ramp waveform Ramp-up is supplied are formed, the set-up discharge is generated between the scan electrodes Y and the address electrodes X and between the scan electrodes Y and the sustain electrodes Z. Due to the set-up discharge, the positive (+) wall charges are accumulated on the address electrodes X and the sustain electrodes Z and the negative (−) wall charges are accumulated on the scan electrodes Y.

The set-up discharge is not generated in the cells where the even scan electrodes Ye to which the discharge control voltage is supplied are formed. In more detail, the discharge control voltage supplied to the even scan electrodes Ye is set as a sustain voltage Vs. Therefore, a voltage to the amount that generates the set-up discharge is not applied to the cells. As a result, the set-up discharge is not generated in the cells where the even scan electrodes Ye are formed.

Subsequent to the rising ramp waveform Ramp-up and the discharge control voltage, the falling ramp waveform Ramp-dn in which a voltage is gradually reduced from the sustain voltage Vs to the first negative voltage –Vy1 is supplied to all of the scan electrodes Y. As illustrated in FIG. 5, the bias voltage Vz is supplied to the sustain electrodes Z at the point of time where the falling ramp waveform Ramp-dn is supplied. However, after the falling ramp waveform is supplied, the bias voltage may be supplied to the sustain electrodes Z at the point of time where the address period starts. At this time, the bias voltage Vz may be determined as the sustain voltage Vs. 0[V] is supplied to the address electrodes X.

When the falling ramp waveform Ramp-dn is supplied, the set-down discharge is generated in the cells where the even scan electrodes Ye in which the set-up discharge is generated are formed. The excessive wall charges that are not required for address discharge among the wall charges generated by the set-up discharge are erased by the set-down discharge. On the other hand, when the falling ramp waveform Ramp-dn is supplied, the set-down discharge is not generated in the cells where the even scan electrodes Ye are formed. Since the wall charges of all of the cells converge into the positions of off-cells by falling ramp waveform Ramp-dn of a previous frame SFi, the set-down discharge is not generated in the cells where the odd scan electrodes Yo are formed.

In the address period, the scan pulses Scp of the second negative voltage –Vy2 whose absolute value is larger than the absolute value of a first negative voltage –Vy1 are sequentially supplied to the scan electrodes Y and, at the same time, the data pulses Dp of the positive data voltage Vd synchronized with the scan pulses Scp are supplied to the address electrodes X. Then, the voltages of the scan pulses Scp and the data pulses Dp and the wall voltage generated in the reset period are added to each other to generate the address discharge in the cell to which the data pulses Dp are supplied. The bias voltage Vz is supplied to the sustain electrodes Z in the address period.

In the sustain period, the sustain pulses sus of the sustain voltage Vs are alternately supplied to the scan electrodes Y and the sustain electrodes Z. In the cell selected by the address discharge, the wall voltage in the cell and the sustain voltage Vs are added to each other such that the sustain discharge is generated between the scan electrodes Y and the sustain electrodes Z whenever each sustain pulse Susp is supplied.

<Sub-Fields subsequent to First Sub-Field>

Reset pulses including the falling ramp pulse Ramp-dn are supplied to all of the scan electrodes Y in the reset periods of the sub-fields SF2, . . . excluding the reset period of the first sub-field SF1 of the second frame.

In more detail, in the reset period of the second sub-field, a voltage lower than the voltage of the rising reset pulse supplied in the reset period of the first sub-field, preferably, the sustain voltage Vs is supplied to the scan electrodes Y for a predetermined time and then, the falling ramp waveform Ramp-dn in which a voltage is gradually reduced from the sustain voltage Vs to the first negative voltage –Vy1 is applied to all of the scan electrodes Y. At this time, the sustain voltage Vs is supplied to a cell for no less than a predetermined time such that initial discharge is generated in the cell and then, the set-down discharge is generated in the cell by the falling ramp waveform Ramp-dn. The excessive wall charges that are not required for the address discharge among the wall charges generated during the initial discharge are erased by the set-down discharge. Since the discharge cells in which the sustain discharge is not generated in the sustain period of the first sub-field sustain off-cell wall charges, the set-down discharge is not generated in the cells.

The bias voltage Vz is supplied to the sustain electrodes Z in the period where the falling ramp waveform Ramp-dn is supplied to the scan electrodes Y. Like in the first sub-field of a jth frame, the bias voltage may be supplied at the point of time where the address period starts.

In the address period, the scan pulses Scp of the second negative voltage –Vy2 whose absolute value is larger than the absolute value of the first negative voltage –Vy1 are sequentially supplied to the scan electrodes Y and, at the same time, the data pulses Dp of the positive data voltage Vd synchronized with the scan pulses Scp are supplied to the address electrodes X.

The voltages of the scan pulses Scp and the data pulses Dp and the wall voltage generated in the reset period are added to each other to generate the address discharge in the cells to which the data pulses Dp are supplied. The bias voltage Vz is supplied to the sustain electrodes Z in the address period.

In the sustain period, the sustain pulses sus of the sustain voltage Vs are alternately supplied to the scan electrodes Y and the sustain electrodes Z. In the cell selected by the address discharge, the wall voltage in the cell and the sustain voltage Vs are added to each other such that the sustain discharge is generated between the scan electrodes Y and the sustain electrodes Z whenever each sustain pulse Susp is supplied.

As described above, according to the present invention, the rising ramp pulse Ramp-up is supplied in the reset period of the first sub-field of one frame. As described above, when the rising ramp pulse Ramp-up is supplied in the reset period of the first sub-field of one frame, the set-up discharge generated by the rising ramp pulse Ramp-up is generated in the first sub-field of one frame and not in the remaining sub-fields. Therefore, it is possible to improve contrast. According to the present invention, the rising ramp waveform Ramp-up is supplied to the even scan electrodes Ye in the reset period of the first sub-field of each of odd (or even) frames and is supplied to the odd scan electrodes Yo in the reset period of the first sub-field of each of even (or odd) frames.

Then, the set-up discharge is generated in the first sub-field of each of the odd (or even) frames only in the cells where the even scan electrodes Ye are formed and is generated in the first sub-field of each of the even (or odd) frames only in the cells where the odd scan electrodes Yo are formed. That is, according to the present invention, the set-up discharge is alternately generated in the cells where the even scan electrodes Ye are formed and the cells where the odd scan electrodes Yo are formed in each frame such that it is possible to improve contrast.

On the other hand, as an experiment, even if the set-up discharge is alternately generated in the cells where the even scan electrodes Ye are formed and the cells where the odd scan electrodes Yo are formed in each frame, an image is stably displayed on a PDP.

The plasma display apparatus according to the present invention that is driven by the first driving method can be driven by other driving methods. For example, according to the present invention, it is possible to make the voltage values of the driving waveforms applied to a boundary between frames various.

Figure 6:
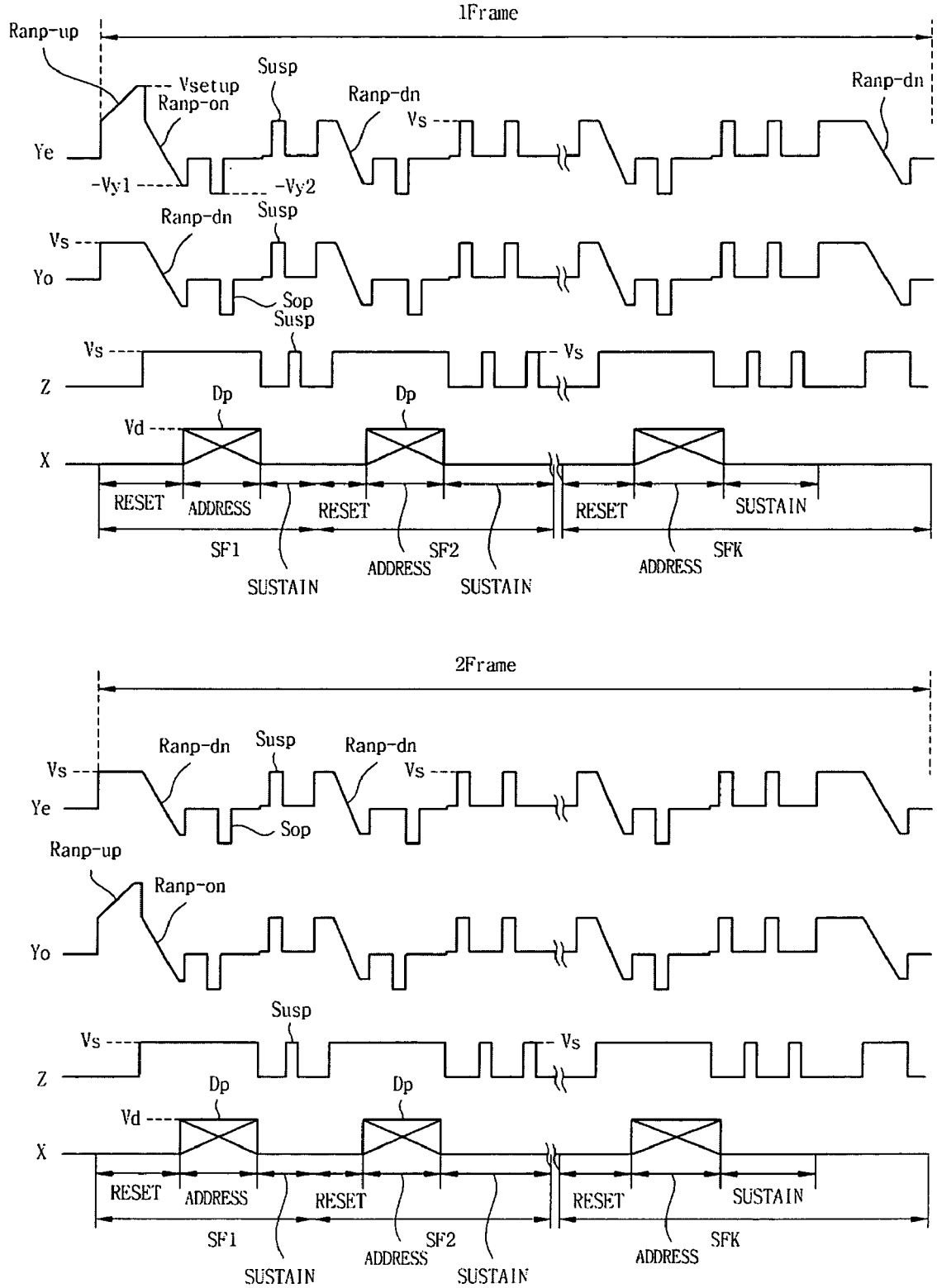
FIG. 6 illustrates a second driving method of the plasma display apparatus according to the present invention.

FIG. 6 illustrates a second driving method of the plasma display apparatus according to the present invention.

Referring to FIG. 6, according to the second driving method of the plasma display apparatus of the present invention, the rising ramp pulse Ramp-up is applied in the reset period of the first sub-field among the plurality of sub-fields included in one frame. Here, the rising ramp pulse Ramp-up is supplied to the even scan electrodes Ye in the first sub-field of each of the odd (or even) frames and is supplied to the odd scan electrodes Yo in the first sub-field of each of the even (or odd) frames.

According to the second driving method of the plasma display apparatus of the present invention as illustrated in FIG. 6, the driving waveforms applied to the periods excluding the driving waveforms supplied to the final sub-field of one frame are actually the same as those of the first driving method of the plasma display apparatus of the present invention as illustrated in FIG. 5. Therefore, detailed description of the periods in which actually the same driving waveforms as those of the first driving method of the plasma display apparatus of the present invention are applied will be omitted.

***First Frame***

The falling ramp waveform Ramp-dn that falls from a voltage lower than the voltage of the rising ramp pulse, preferably, the sustain voltage Vs is supplied to the odd scan electrodes Yo to which the rising ramp pulse Ramp-up is not supplied in the reset period of the first sub-field of the first frame after the sustain period of the final sub-field SFk. At this time, the sustain voltage Vs is supplied to the cells in which the odd scan electrodes Yo are formed for no less than a predetermined time such that the sustain discharge is generated in the cells and then, the set-down discharge is generated in the cells by the falling ramp waveform Ramp-dn. The excessive wall charges that are not required for the address discharge among the wall charges generated during the sustain discharge are erased by the set-down discharge.

The sustain voltage Vs is supplied to the even scan electrodes Ye to which the rising ramp pulse Ramp-up is supplied in the reset period of the first sub-field of the first frame after the sustain period of the final sub-field SFk. The sustain voltage Vs is supplied to the reset period of the first sub-field of the next frame.

On the other hand, when a pulse formed by making the odd scan electrodes Yo sustain a voltage lower than the voltage of the rising ramp pulse, preferably, the sustain voltage for a predetermined time after the sustain period of the final sub-field SFk is referred to as a first sustain pulse and a pulse formed by making the even scan electrodes Ye sustain the sustain voltage Vs for a predetermined time after the sustain period of the final sub-field SFk is referred to as a second sustain pulse, the supply time of the first sustain pulse is shorter than the supply time of the second sustain pulse.

***Second Frame***

The rising ramp waveform Ramp-up of the set-up voltage Vsetup is supplied to the odd scan electrodes Yo in the reset period of the first sub-field SF1 of the second frame. At this time, the even scan electrodes Ye sustain the sustain voltage Vs (the discharge control voltage) applied from the final sub-field of the previous frame. 0[V] is supplied to the sustain electrodes Z and the address electrodes X.

In the cells where the odd scan electrodes Yo to which the rising ramp waveform Ramp-up is supplied are formed, the set-up discharge is generated between the scan electrodes Y and the address electrodes X and between the scan electrodes Y and the sustain electrodes Z. Due to the set-up discharge, the positive (+) wall charges are accumulated on the address electrodes X and the sustain electrodes Z and the negative (−) wall charges are accumulated on the scan electrodes Y.

The set-up discharge is not generated in the cells where the even scan electrodes Ye to which the sustain voltage Vs is supplied are formed. Subsequent to the rising ramp waveform Ramp-up and the sustain voltage Vs, the falling ramp waveform Ramp-dn in which a voltage is gradually reduced from the sustain voltage Vs to the first negative voltage −Vy1 is supplied to all of the scan electrodes Y. At the same time, the bias voltage Vz is supplied to the sustain electrodes Z and 0[V] is supplied to the address electrodes X.

When the falling ramp waveform Ramp-dn is supplied, the set-down discharge is generated in the cells where the odd scan electrodes Yo in which the set-up discharge is generated are formed and in the cells where the even scan electrodes Ye that sustain the wall charges formed by the sustain discharge are formed. The excessive wall charges that are not required for the address discharge among the wall charges formed in the cells are erased by the set-down discharge.

According to the second driving method of the plasma display apparatus of the present invention, the sustain voltage Vs applied from a period after the final sub-field of a previous frame is sustained to the reset period of the current frame. That is, the sustain voltage Vs applied after the sustain period of the final sub-field of the previous frame is sustained until the falling ramp pulse Ramp-dn is supplied to the odd or even scan electrodes Yo or Ye. The second driving method of the plasma display apparatus according to the present invention is actually the same as the first driving method of the plasma display apparatus according to the present invention.

Figure 7:
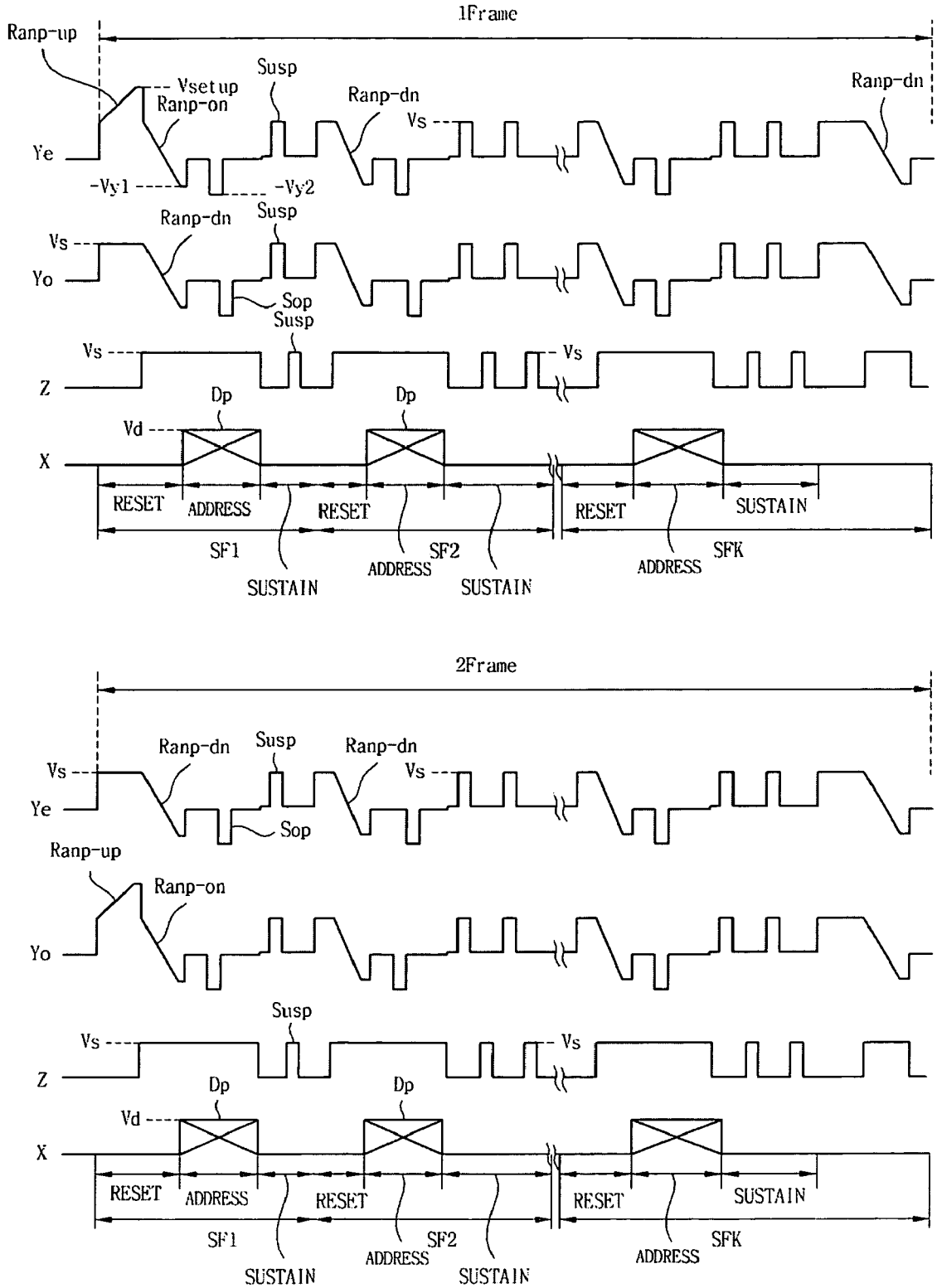
FIG. 7 illustrates a third driving method of the plasma display apparatus according to the present invention.

FIG. 7 illustrates a third driving method of the plasma display apparatus according to the present invention.

Referring to FIG. 7, according to the third driving method of the plasma display apparatus of the present invention, the rising ramp pulse Ramp-up is applied in only the reset period of the first sub-field among the plurality of sub-fields included in one frame. Here, the rising ramp pulse Ramp-up is supplied to only the even scan electrodes Ye in the first sub-field of each of the odd (or even) frames and is supplied to only the odd scan electrodes Yo in the first sub-field of each of the even (or odd) frames.

According to the third driving method of the plasma display apparatus of the present invention as illustrated in FIG. 7, the driving waveforms applied in the periods excluding the driving waveforms supplied to the final sub-field of one frame are actually the same as those of the first driving method of the plasma display apparatus of the present invention as illustrated in FIG. 5. Therefore, detailed description of the periods in which actually the same driving waveforms as those of the third driving method of the plasma display apparatus of the present invention are applied will be omitted.

***First Frame***

The sustain voltage Vs is supplied to all of the scan electrodes Ye and Yo after the sustain period of the final sub-field of the first frame. The sustain voltage Vs is supplied to the reset period of the first sub-field of the next frame.

***Second Frame***

The rising ramp waveform Ramp-up that rises from the sustain voltage Vs supplied from the final sub-field SFk of the jth frame to the set-up voltage Vsetup is supplied to the odd scan electrodes Yo in the reset period of the first sub-field SF1 of the second frame. At this time, the even scan electrodes Ye sustain the sustain voltage Vs applied from the final sub-field of the previous frame. 0[V] is supplied to the sustain electrodes Z and the address electrodes X.

In the cells where the odd scan electrodes Yo to which the rising ramp waveform Ramp-up is supplied are formed, the set-up discharge is generated between the scan electrodes Y and the address electrodes X and between the scan electrodes Y and the sustain electrodes Z. Due to the set-up discharge, the positive (+) wall charges are accumulated on the address electrodes X and the sustain electrodes Z and the negative (−) wall charges are accumulated on the scan electrodes Y.

The set-up discharge is not generated in the cells where the even scan electrodes Ye to which the sustain voltage Vs is supplied are formed. Subsequent to the rising ramp waveform Ramp-up and the sustain voltage Vs, the falling ramp waveform Ramp-dn in which a voltage is gradually reduced from the sustain voltage Vs to the first negative voltage −Vy1 is supplied to all of the scan electrodes Y. At the same time, the bias voltage Vz is supplied to the sustain electrodes Z and 0[V] is supplied to the address electrodes X.

When the falling ramp waveform Ramp-dn is supplied, the set-down discharge is generated in the cells where the odd scan electrodes Yo in which the set-up discharge is generated are formed and in the cells where the even scan electrodes Ye that sustain the wall charges formed by the sustain discharge are formed. The excessive wall charges that are not required for the address discharge among the wall charges formed in the cells are erased by the set-down discharge.

According to the third driving method of the plasma display apparatus of the present invention, the sustain voltage Vs is applied to the scan electrodes Y after the sustain period of the final sub-field of a frame. The sustain voltage Vs supplied to the scan electrodes Y is sustained until the rising ramp pulse Ramp-up or the falling ramp pulse Ramp-dn is supplied in the reset period of the first sub-field of the next frame. The third driving method of the plasma display apparatus according to the present invention is actually the same as the first driving method of the plasma display apparatus according to the present invention.

Figure 8:
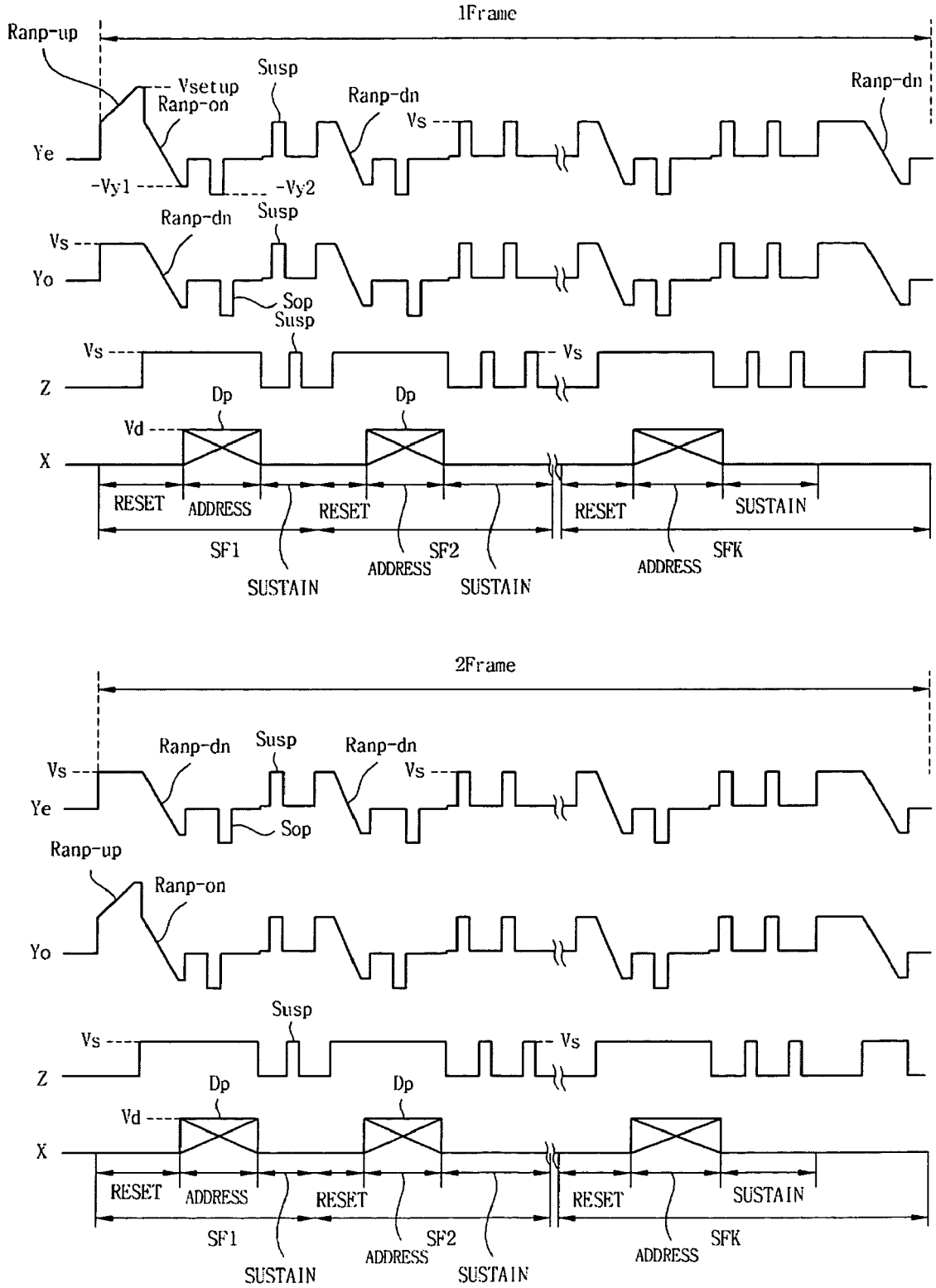
FIG. 8 illustrates a fourth driving method of the plasma display apparatus according to the present invention.

On the other hand, according to the third driving method of the plasma display apparatus of the present invention, the rising ramp pulse Ramp-up may be applied after the sustain period of a previous frame as illustrated in FIG. 8, in which a fourth driving method of the plasma display apparatus according to the present invention is illustrated. For example, the rising ramp pulse Ramp-up may be supplied to the even (or odd) scan electrodes Ye (or Yo) after the final sustain period of each of the even (or odd) frames. At this time, the rising ramp pulse Ramp-up supplied to the even (or odd) scan electrodes Ye (or Yo) sustains the set-up voltage until the falling ramp pulse Ramp-dn is supplied in the reset period of the next frame.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus for displaying an image with one frame comprised of a plurality of sub-fields including reset periods, wherein different reset pulses are supplied to a first scan electrode and a second scan electrode in a reset period of an arbitrary sub-field among the plurality of sub-fields, a magnitude of a reset pulse supplied to the first scan electrode is different from a magnitude of a reset pulse supplied to the second electrode, and a polarity of the reset pulse supplied to the first scan electrode is equal to a polarity of the reset pulse supplied to the second electrode.

2. The plasma display apparatus as claimed in claim 1, wherein the first scan electrode and the second scan electrode are adjacent to each other.

3. The plasma display apparatus as claimed in claim 2, wherein each of the first scan electrode and the second scan electrode is comprised of a scan electrode group comprising two or more scan electrodes.

4. The plasma display apparatus as claimed in claim 1, wherein the arbitrary sub-field is the first sub-field of the frame.

5. The plasma display apparatus as claimed in claim 1, wherein a reset pulse supplied to the first scan electrode in the reset period of the first sub-field of the frame among the arbitrary sub-fields comprises a rising ramp pulse and a falling ramp pulse, and wherein a reset pulse supplied to the second scan electrode in the reset period of the first sub-field of the frame among the arbitrary sub-fields comprises the falling ramp pulse.

6. The plasma display apparatus as claimed in claim 4 or 5, wherein the first sub-field of the frame has the lowermost weight.

7. The plasma display apparatus as claimed in claim 5, wherein the reset pulse supplied to the first scan electrode and the second scan electrode in the reset periods of the remaining sub-fields excluding the first sub-field of the frame comprises the falling ramp pulse.

8. The plasma display apparatus as claimed in claim 5, wherein the second scan electrode sustains a voltage lower than the voltage of the rising ramp pulse in a period where the rising ramp pulse is supplied to the first scan electrode.

9. The plasma display apparatus as claimed in claim 8, wherein a voltage lower than the voltage of the rising ramp pulse is a sustain voltage.

10. The plasma display apparatus as claimed in claim 5, wherein the pulse supplied to the first scan electrode and the second scan electrode after the sustain period of the final sub-field of the frame comprises the falling ramp pulse.

11. The plasma display apparatus as claimed in claim 5, wherein the pulse supplied to the first scan electrode after the sustain period of the final sub-field of the frame comprises a sustain pulse sustained as the sustain voltage and the falling ramp pulse that falls from the sustain voltage to a predetermined voltage, and wherein the pulse supplied to the second scan electrode after the sustain period of the final sub-field of the frame is the sustain pulse sustained as the sustain voltage.

12. The plasma display apparatus as claimed in claim 11, wherein the period of the sustain pulse supplied to the first scan electrode is shorter than the period of the sustain pulse supplied to the second scan electrode.

13. The plasma display apparatus as claimed in claim 11, wherein the sustain pulse of the sustain voltage supplied to the second scan electrode is sustained before the falling ramp pulse is supplied to the first scan electrode in the reset period of the first sub-field of the next frame after the frame.

14. The plasma display apparatus as claimed in claim 5, wherein the pulse supplied to the first scan electrode and the second scan electrode after the sustain period of the final sub-field of the frame is a sustain pulse sustained as the sustain voltage.

15. The plasma display apparatus as claimed in claim 14, wherein the sustain pulse of the sustain voltage, supplied to the first scan electrode and the second scan electrode, is sustained before the falling ramp pulse is supplied to the first scan electrode and the rising ramp pulse is supplied to the second scan electrode in the reset period of the first sub-field of the next frame after the frame.

16. The plasma display apparatus as claimed in claim 5, wherein the pulse supplied to the first scan electrode after the sustain period of the final sub-field of the frame is the rising ramp pulse that gradually rises from the sustain voltage to a predetermined voltage, and wherein the pulse supplied to the second scan electrode after the sustain period of the final sub-field of the frame is the sustain pulse sustained as the sustain voltage.

17. The plasma display apparatus as claimed in claim 16, wherein the predetermined voltage of the rising ramp pulse supplied to the first scan electrode and the sustain voltage of the sustain pulse supplied to the second scan electrode are sustained to the reset period of the first sub-field of the next frame after the frame.

18. A method of driving a plasma display apparatus for displaying an image with one frame comprised of a plurality of sub-fields including reset periods, wherein different reset pulses are supplied to a first scan electrode and a second scan electrode in a reset period of an arbitrary sub-field among the plurality of sub-fields, a magnitude of a reset pulse supplied to the first scan electrode is different from a magnitude of a reset pulse supplied to the second electrode, and a polarity of the reset pulse supplied to the first scan electrode is equal to a polarity of the reset pulse supplied to the second electrode.

19. The method as claimed in claim 18, wherein the first scan electrode and the second scan electrode are adjacent to each other.

20. The method as claimed in claim 19, wherein each of the first scan electrode and the second scan electrode is comprised of a scan electrode group comprising two or more scan electrodes.

21. The method as claimed in claim 18, wherein the arbitrary sub-field is a first sub-field of the frame.

22. The method as claimed in claim 18, wherein a reset pulse supplied to the first scan electrode in the reset period of the first sub-field of the frame among the arbitrary sub-fields comprises a rising ramp pulse and a falling ramp pulse, and wherein a reset pulse supplied to the second scan electrode in the reset period of the first sub-field of the frame among the arbitrary sub-fields comprises the falling ramp pulse.

23. The method as claimed in claim 21 or 22, wherein the first sub-field of the frame has the lowermost weight.

24. The method as claimed in claim 22, wherein the reset pulse supplied to the first scan electrode and the second scan electrode in the reset periods of the remaining sub-fields excluding the first sub-field of the frame comprises the falling ramp pulse.

25. The method as claimed in claim 22, wherein the second scan electrode sustains a voltage lower than the voltage of the rising ramp pulse in a period where the rising ramp pulse is supplied to the first scan electrode.

26. The method as claimed in claim 25, wherein a voltage lower than the voltage of the rising ramp pulse is a sustain voltage.

27. The method as claimed in claim 22, wherein the pulse supplied to the first scan electrode and the second scan electrode after the sustain period of the final sub-field of the frame comprises the falling ramp pulse.

28. The method as claimed in claim 22, wherein the pulse supplied to the first scan electrode after the sustain period of the final sub-field of the frame comprises a sustain pulse sustained as the sustain voltage and the falling ramp pulse that falls from the sustain voltage to a predetermined voltage, and wherein the pulse supplied to the second scan electrode after the sustain period of the final sub-field of the frame is the sustain pulse sustained as the sustain voltage.

29. The method as claimed in claim 28, wherein the period of the sustain pulse supplied to the first scan electrode is shorter than the period of the sustain pulse supplied to the second scan electrode.

30. The method as claimed in claim 28, wherein the sustain pulse of the sustain voltage supplied to the second scan electrode is sustained before the falling ramp pulse is supplied to the first scan electrode in the reset period of the first sub-field of the next frame after the frame.

31. The method as claimed in claim 22, wherein the pulse supplied to the first scan electrode and the second scan electrode after the sustain period of the final sub-field of the frame is a sustain pulse sustained as the sustain voltage.

32. The method as claimed in claim 31, wherein the sustain pulse of the sustain voltage supplied to the first scan electrode and the second scan electrode is sustained before the falling ramp pulse is supplied to the first scan electrode and the rising ramp pulse is supplied to the second scan electrode in the reset period of the first sub-field of the next frame after the frame.

33. The method as claimed in claim 22, wherein the pulse supplied to the first scan electrode after the sustain period of the final sub-field of the frame is the rising ramp pulse that gradually rises from the sustain voltage to a predetermined voltage, and wherein the pulse supplied to the second scan electrode after the sustain period of the final sub-field of the frame is the sustain pulse sustained as the sustain voltage.

34. The method as claimed in claim 33, wherein the predetermined voltage of the rising ramp pulse supplied to the first scan electrode and the sustain voltage of the sustain pulse supplied to the second scan electrode are sustained to the reset period of the first sub-field of the next frame after the frame.

* * * * *